United States Patent [19]

Davis

[11] Patent Number: 4,891,032

[45] Date of Patent: Jan. 2, 1990

[54] FLEXIBLE TOY WAND

[76] Inventor: David C. Davis, 74 Christman Ave., Washington, Pa. 15301

[21] Appl. No.: 242,498

[22] Filed: Sep. 12, 1988

[51] Int. Cl.[4] ..... A63H 29/22; A63H 33/26

[52] U.S. Cl. ..... 446/484; 446/485

[58] Field of Search ..... 446/219, 484, 485, 231, 446/397, 34

[56] References Cited

U.S. PATENT DOCUMENTS

| | | | |
|---|---|---|---|
| 879,640 | 2/1908 | Hockenberry | 446/485 |
| 2,959,892 | 11/1960 | Johnson | 446/485 |
| 3,066,439 | 12/1962 | Lemelson | 446/485 |
| 3,605,333 | 9/1971 | Copeland | 446/485 |
| 3,707,055 | 12/1972 | Pearce | 446/485 |
| 4,231,077 | 10/1980 | Joyce et al. | 446/485 |
| 4,282,681 | 8/1981 | McCaslin | 446/484 |
| 4,713,039 | 12/1987 | Wong | 446/484 |

FOREIGN PATENT DOCUMENTS

| | | | |
|---|---|---|---|
| 0132100 | 1/1985 | European Pat. Off. | 446/34 |

*Primary Examiner*—Robert A. Hafer
*Assistant Examiner*—Michael Brown
*Attorney, Agent, or Firm*—William J. Ruano

[57] ABSTRACT

A flexible toy wand having a battery case at its lower end which also serves as the handle of the wand and a decorative lightable end piece at the tip of the wand. The wand is waved in a darkened area and various paths of light are created by the movement of the lighted end piece.

1 Claim, 1 Drawing Sheet

FLEXIBLE TOY WAND

This invention relates to a toy wand which is flexible and has an illuminated end piece for creating geometric patterns of light when the wand is rapidly waved.

BACKGROUND OF THE INVENTION

While toy wands are not novel in the field of children's toys, none of the prior art has combined the use of an illuminated, decorative end piece with a flexible wand and self contained battery case to provide an entertaining means of creating patterns of light by rapidly waving the lighted wand.

SUMMARY OF THE INVENTION

A flexible toy wand in accordance with the present invention comprises a soft decorative end piece made of transparent or translucent material with a light source imbedded therein, a flexible, tubular body serving as the wand with a battery case attached to the lower portion of the wand to provide both a housing for the batteries and a handle for the wand. The child switches on the light source and waves the wand in a darkened area much the same as one would wave a sparkler to create interesting paths of light.

DETAILED DESCRIPTION OF THE PREFERRED EMBODIMENT

Figure 1:
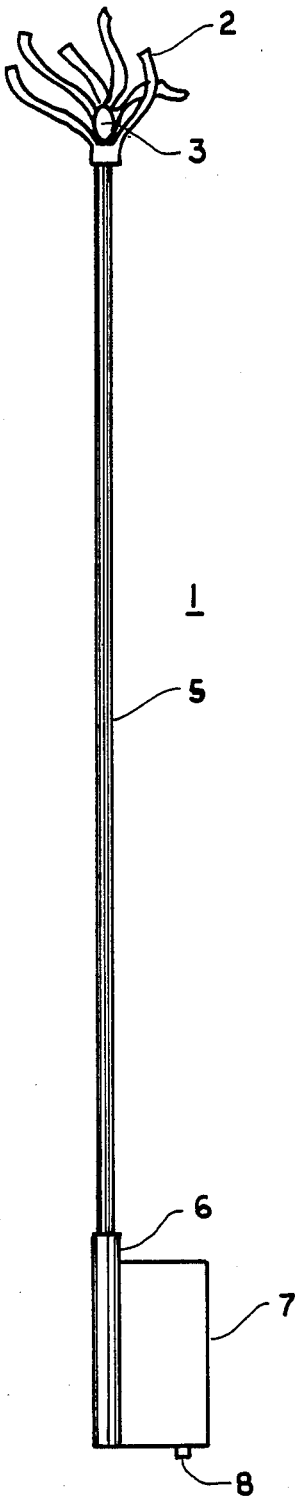
FIG. 1 is a front elevational view of a flexible toy wand with a flower type decorative end piece.

Referring to FIG. 1, which shows a front elevation, numeral 1 generally denotes a flexible toy wand comprising a protective top piece 2, said top piece being transparent or translucent so as to allow the glow from an embedded light source 3 to be visible. Said top piece 2 should be made of a soft material such as rubber, flexible plastic or styrofoam for safety reasons as well as to protect said light source and more particularly, to protect the child from damage to the eye if another child is recklessly waving the wand.

Figure 2:
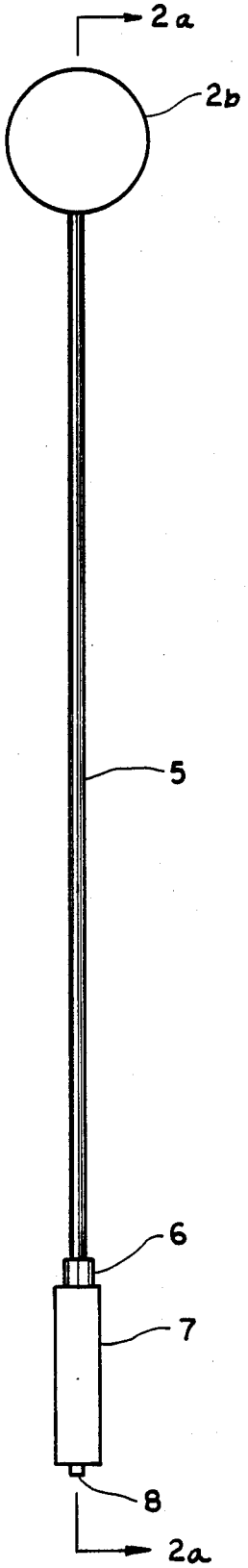
FIG. 2 is a side elevational view of a flexible toy wand with a ball type decorative end piece.

In addition, said top piece 2 can be made in a variety of shapes, such as a flower shown in FIG. 1, a ball as shown in FIG. 2, or any desirable shape.

Still referring to FIG. 1, numeral 5 denotes a hollow flexible shaft, approximately 15 inches in length and preferably of plastic, either transparent or opaque, serving as the body of the wand. Rigidly attached to the upper portion of said wand is light source 3, either of an incandescent or glow discharge construction. The light source 3 is energized by a pair of wires 4,4*a* connected thereto and passing through the hollow body of said wand 5 and terminating at a switching means 8 located on the bottom portion of battery case 7. The switching means is preferably of a simple spring type construction for easy operation and low cost considerations. The lower portion of wand 5 is snugly fitted into a reinforcing plastic sleeve 6 and terminates approximately midway inside of the battery case 7. Reinforcing sleeve 6 extends from the base of the battery case to approximately one half an inch above the case. This reinforcement is necessary to prevent the wand from kinking and breaking during use at the point where it enters the battery case.

FIG. 2 shows a side elevational view of the flexible toy wand 1 having a styrofoam ball 2*b* as its decorative end piece.

Figure 2A:
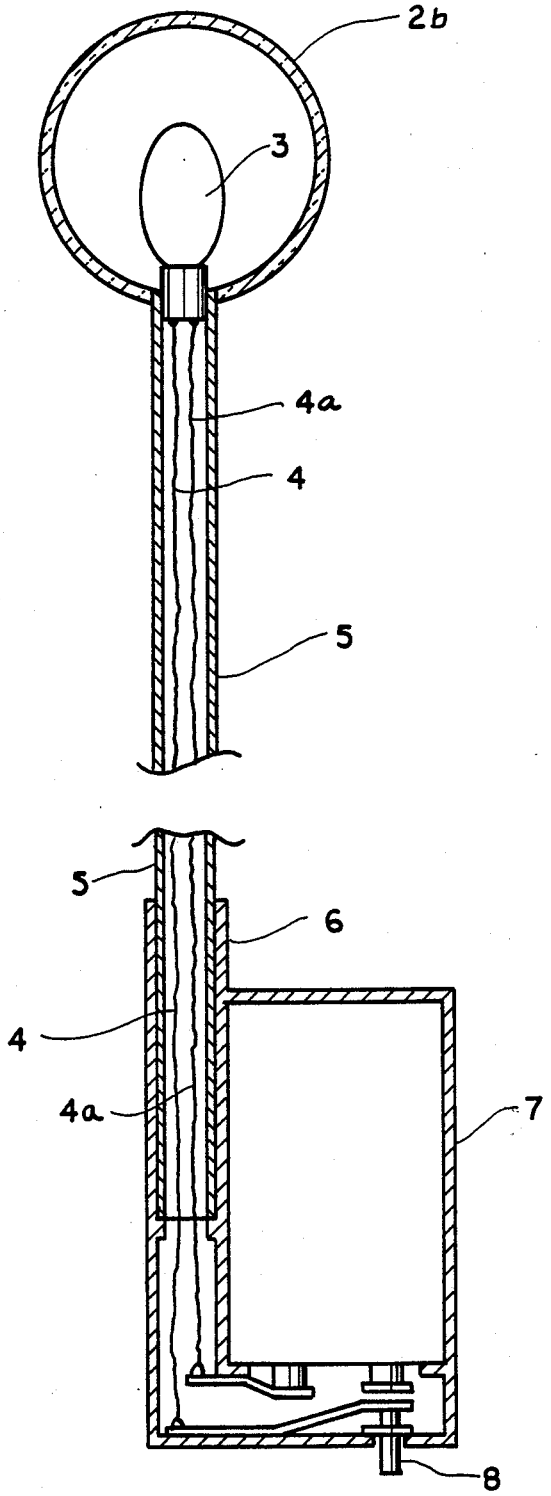
FIG. 2*a* is an enlarged vertical cross section taken along line 2*a* of FIG. 2.

Referring to FIG. 2*a*, numeral 2*b* shows a ball type decorative end piece in cross section taken along line 2*a* of FIG. 2 , revealing the embedded light source 3 and wires 4,4*a* which pass through wand 5 and terminate at switching means 8. Battery case 7 also serves as a handle for the toy wand.

In operation, the switch is depressed to complete the battery circuit to light the decorative top piece of the toy wand and the wand is then waved back and forth in the dark in a circular, straight, elliptical or any other motion to create various geometric designs as described by the path of the light source, again, much the same as one would play with a sparkler. Two or more children can wave their wands so that the paths of the different wands intersect, creating apparently intersecting shapes of light.

Thus it will be seen that I have provided a safe and novel toy wand with a lightable, decorative end piece to amuse children by their waving of the wand and creating an endless variety of geometric shapes through the path of the lighted end piece.

While I have illustrated and described a single embodiment of my invention, it will be understood that it is by way of illustration and that various changes and other modifications are contemplated within the scope of the following claims.

I claim:

1. A toy wand having a flexible, hollow, tubular body of relative small diameter, a battery case integrally connected to the lower end of said body serving as a handle and enclosing a battery and a switching means, an elongated cylindrical casing integrally attached to said battery case, one end of said elongated casing extending past the housing of said battery case, said tubular body housed within said cylindrical casing so that the portion of said cylindrical casing extending past said battery housing reinforces said tubular body during movement, a light source positioned at the upper end portion of said body, and connected in series through said body with said battery and switching means, whereby when the battery case is grasped and moved in a circular or elliptical path, said tubular body will flex, said end piece being made of flower-like, flexible, translucent plastic strips, surrounding said light source, so as to make visible the light source.

* * * * *